US010648720B2

(12) United States Patent
Yoshikawa

(10) Patent No.: US 10,648,720 B2
(45) Date of Patent: May 12, 2020

(54) ICE-MAKING CONTAINER

(71) Applicant: Kabushiki Kaisha Yoshikawakuni Kogyosho, Nara (JP)

(72) Inventor: Toshiyuki Yoshikawa, Nara (JP)

(73) Assignee: Kabushiki Kaisha Yoshikawakuni Kogyosho, Nara (JP)

( * ) Notice: Subject to any disclaimer, the term of this patent is extended or adjusted under 35 U.S.C. 154(b) by 245 days.

(21) Appl. No.: 15/569,061

(22) PCT Filed: Jun. 29, 2017

(86) PCT No.: PCT/JP2017/023952

§ 371 (c)(1),
(2) Date: Oct. 24, 2017

(87) PCT Pub. No.: WO2018/189917

PCT Pub. Date: Oct. 18, 2018

(65) Prior Publication Data

US 2019/0049165 A1 Feb. 14, 2019

(30) Foreign Application Priority Data

Apr. 14, 2017 (JP) ..... 2017-080456

(51) Int. Cl.
*F25C 1/22* (2018.01)
*F25C 5/06* (2006.01)
(Continued)

(52) U.S. Cl.
CPC ..... *F25C 1/22* (2013.01); *F25C 1/24* (2013.01); *F25C 5/04* (2013.01); *F25C 5/06* (2013.01)

(58) Field of Classification Search
CPC ..... F25C 1/22; F25C 5/06; F25C 5/04; F25C 1/24
(Continued)

(56) References Cited

U.S. PATENT DOCUMENTS 723,796 A * 3/1903 Williams ..... B65D 81/3869 220/592.17
929,389 A * 7/1909 Clement ..... F25D 31/007 62/331
(Continued)

FOREIGN PATENT DOCUMENTS

CN 2896152 Y 5/2007
CN 202801043 U 3/2013
(Continued)

OTHER PUBLICATIONS

Korean Notice of Allowance dated Jun. 20, 2019 issued in connection with Korean Patent Appl. No. 2017-7024948.
(Continued)

*Primary Examiner* — Ljiljana V. Ciric
(74) *Attorney, Agent, or Firm* — Brooks Kushman P.C.

(57) ABSTRACT

An ice-making container including a container body having an opening formed in its upper part and being flexible so as to be deformable by being grasped and an inner container configured to be insertable into and removable from the container body through the opening, in which an ice-making area for making ice is formed between an inner peripheral surface of the container body and an outer peripheral surface of the inner container, in the state where the inner container is placed in the container body, and the ice-making area is formed as an area where the ice made in the ice-making area is crushed in response to deformation of the container body being grasped.

4 Claims, 10 Drawing Sheets

(51) Int. Cl.
*F25C 5/04* (2006.01)
*F25C 1/24* (2018.01)

(58) Field of Classification Search
USPC ..... 220/568, 592.05, 592.16, 592.17
See application file for complete search history.

(56) References Cited

U.S. PATENT DOCUMENTS 1,075,119 A * 10/1913 Reichner ..... A47J 19/022 99/508
1,094,712 A * 4/1914 Gale ..... A47J 43/27 220/568
1,661,336 A * 3/1928 Katz ..... A47J 43/27 99/508
1,954,369 A * 4/1934 Solomon ..... A47J 43/27 215/6
2,048,041 A * 7/1936 Cobb ..... A47G 23/04 62/56
2,683,359 A * 7/1954 Green, Jr. ..... F25C 5/06 62/68
2,798,701 A * 7/1957 Collura ..... A47J 43/0727 366/205
2,838,194 A * 6/1958 Piker ..... A47J 41/0077 215/13.1
2,838,916 A * 6/1958 Planes Y Sola ..... F25D 31/008 62/336
2,921,706 A * 1/1960 Johnson ..... A47G 19/145 215/12.1
2,952,133 A * 9/1960 Miller ..... F25D 3/08 62/1
2,961,849 A * 11/1960 Hitchcock ..... F25C 1/24 249/83
3,082,900 A * 3/1963 Goodman ..... B65D 1/265 220/592.17
RE25,618 E * 7/1964 Goodman ..... B65D 1/265 220/592.17
3,207,484 A * 9/1965 Rubin ..... B01F 5/0682 366/336
3,404,543 A * 10/1968 Diblick ..... F25C 1/125 62/344
3,603,106 A * 9/1971 Ryan ..... A47G 19/2288 62/457.4
3,684,234 A * 8/1972 Clinebell ..... F25C 1/22 249/112
3,765,559 A * 10/1973 Sauey ..... A47G 19/2288 220/592.16
3,782,602 A * 1/1974 Page ..... B65D 21/0219 222/143
4,003,555 A * 1/1977 Swartz ..... A47J 43/27 366/130
4,142,377 A * 3/1979 Fogt ..... F25C 1/04 62/135
4,206,899 A * 6/1980 Whitehead ..... F25C 1/22 249/139
4,383,422 A * 5/1983 Gordon ..... B65D 81/3886 215/13.1
4,498,595 A * 2/1985 Wilson ..... F25C 1/24 206/513
4,601,174 A * 7/1986 Wilson ..... F25C 1/24 62/356
4,625,518 A * 12/1986 Freedman ..... A47G 19/2288 62/1
4,843,827 A * 7/1989 Peppers ..... F25C 1/12 62/73
5,177,981 A * 1/1993 Haas ..... A47G 19/2288 62/1
5,224,646 A * 7/1993 Biancosino ..... A23G 9/288 220/501
5,250,315 A * 10/1993 Loew ..... F25C 1/243 426/515
5,419,856 A * 5/1995 Shaw ..... A23G 9/44 249/149
6,085,927 A * 7/2000 Kusz ..... B65D 77/0493 215/6
6,190,226 B1 * 2/2001 Conconi ..... A23G 9/44 294/5.5
6,332,557 B1 * 12/2001 Moran ..... A47J 41/0083 215/12.1
6,481,014 B1 * 11/2002 Banks ..... F25D 3/08 220/592.17
6,557,351 B1 * 5/2003 Ghedini ..... A47G 19/2288 215/393
7,124,603 B2 * 10/2006 Bianco ..... A47G 19/2288 62/457.3
7,341,754 B1 * 3/2008 Loh ..... B65D 21/0238 206/217
7,882,706 B2 * 2/2011 Thali ..... F25C 1/22 249/119
8,151,577 B2 4/2012 Bucceri
8,763,835 B2 * 7/2014 Tirone ..... A21C 15/005 220/23.87
9,078,535 B1 * 7/2015 Buck ..... A47G 19/2205
9,204,752 B2 * 12/2015 Dakis ..... A47J 31/404
D763,621 S * 8/2016 Szymanski ..... D7/392.1
9,723,856 B2 * 8/2017 Inoue ..... A23G 9/04
9,826,753 B2 11/2017 Inoue
10,231,470 B2 3/2019 Inoue
2003/0002385 A1 * 1/2003 Pola ..... A47G 19/2205 366/130
2004/0045972 A1 * 3/2004 Stokes ..... A47G 19/2288 220/592.17
2005/0056048 A1 * 3/2005 Fuchs ..... A45C 11/20 62/457.7
2005/0183446 A1 * 8/2005 Fuchs ..... A45C 11/20 62/457.7
2006/0054622 A1 * 3/2006 Agnello ..... A47G 19/12 220/23.87
2007/0209384 A1 * 9/2007 Stewart ..... A47G 23/0241 62/457.2
2009/0242732 A1 * 10/2009 Garmizo ..... A47G 19/2288 249/204
2010/0133285 A1 * 6/2010 Schepen ..... B65D 21/0233 220/781
2010/0206174 A1 * 8/2010 Loden ..... A47J 43/27 99/275
2011/0020515 A1 1/2011 Bucceri
2011/0262600 A1 * 10/2011 McGill ..... A23G 9/045 426/112
2012/0031137 A1 2/2012 Bucceri
2012/0104042 A1 * 5/2012 Tirone ..... F25D 3/08 222/105
2012/0108407 A1 * 5/2012 Trani ..... B65D 43/0229 493/52
2012/0193366 A1 * 8/2012 Miller ..... B65D 81/3879 220/592.17
2012/0267378 A1 * 10/2012 Hays ..... A47G 19/2288 220/592.17
2013/0156918 A1 * 6/2013 Reinhardt ..... A23G 9/221 426/515
2013/0186113 A1 * 7/2013 Chung ..... F25C 1/22 62/66
2013/0233866 A1 * 9/2013 Dooley ..... B65D 81/18 220/592.17
2013/0255824 A1 * 10/2013 Williams ..... B65D 81/18 141/1
2014/0157795 A1 * 6/2014 Joseph ..... F25D 5/02 62/4
2015/0021458 A1 * 1/2015 Zorovich ..... B29C 33/0038 249/134
2015/0107275 A1 * 4/2015 Papalia ..... F25C 1/18 62/67
2015/0327704 A1 * 11/2015 Malinowski ..... B65D 25/04 249/163
2016/0033186 A1 * 2/2016 Sherbeck ..... F25C 1/04 62/71
2017/0038130 A1 * 2/2017 Hintsanen ..... F25C 1/22

(56) References Cited

U.S. PATENT DOCUMENTS

| | | | | |
|---|---|---|---|---|
| 2017/0332696 | A1* | 11/2017 | Bowmaster | A24F 1/30 |
| 2018/0192673 | A1* | 7/2018 | Lefkovitz | F25C 1/24 |

FOREIGN PATENT DOCUMENTS

| | | | |
|---|---|---|---|
| CN | 204963338 | U | 1/2016 |
| JP | S50-022552 | U | 3/1975 |
| JP | S53-099549 | A | 8/1978 |
| JP | S54-109166 | U | 8/1979 |
| JP | S63-049462 | U | 4/1988 |
| JP | H03-045874 | A | 2/1991 |
| JP | H08-14719 | A | 1/1996 |
| JP | 2003-246310 | A | 9/2003 |
| JP | 2007-212051 | A | 8/2007 |
| JP | 2008-032374 | A | 2/2008 |
| JP | 2012-068003 | A | 4/2012 |
| KR | 2015-0095955 | A | 8/2015 |
| KR | 2016-0000490 | U | 2/2016 |
| KR | 101613908 | B1 | 4/2016 |
| TW | M440425 | U | 11/2012 |
| WO | WO2009/079721 | A1 | 7/2009 |

OTHER PUBLICATIONS

Taiwanese Office Action dated Mar. 28, 2018 issued in connection with Taiwanese Patent Appl. No. 106122567.
Korean Office Action dated Jan. 11, 2019 issued in connection with Korean Patent Appl. No. 2017-7024948.
International Preliminary Report dated Oct. 24, 2019 in connection with PCT/JP2017/023952.

* cited by examiner

ICE-MAKING CONTAINER

CROSS-REFERENCE TO RELATED APPLICATION

This application claims priority to Japanese Patent Application No. 2017-080456, the disclosure of which is incorporated herein by reference in its entirety.

FIELD

The present invention relates to an ice-making container for making crushed ice.

BACKGROUND

Conventionally, an ice-making tray formed in a tray shape is known as means for making crushed ice (Patent Literature 1).

The ice-making tray in Patent Literature 1 includes a bottom plate made of a flexible material, a peripheral wall made of a flexible material formed in a standing manner from a peripheral edge of the bottom plate, and a plurality of projections for crushing ice provided in a standing manner on the bottom plate, and is constructed to fill an area with water, the area being surrounded by the bottom plate and the peripheral wall.

The ice-making tray in Patent Literature 1 is formed in a tray shape. Water is filled in an area surrounded by the bottom plate and the peripheral wall, and the tray is put in a freezer in order to freeze the water. Then, the ice made in the area is crushed by the projections for crushing ice when the bottom plate and the peripheral wall are deformed. Thus, according to the ice-making tray in Patent Literature 1, crushed ice can be made easily only by deforming the bottom plate and the peripheral wall.

CITATION LIST

Patent Literature

Patent Literature 1: JP 2007-212051 A

However, since the aforementioned conventional ice-making tray is formed in the tray shape, the crushed ice made as above cannot be moved easily to a cup or the like. Thus, a user needs to pick up the crushed ice on the ice-making tray and to move it to the cup or the like.

As described above, the aforementioned conventional ice-making tray has a problem of insanitariness because the crushed ice needs to be touched when it is to be moved to another container.

SUMMARY

Technical Problem

Thus, an object of the present invention is to provide an ice-making container with which crushed ice can be moved to a certain container hygienically.

Solution to Problem

An ice-making container according to the present invention includes a container body having an opening formed in its upper part and being flexible so as to be deformable by being grasped, and an inner container configured to be insertable into and removable from the container body through the opening, and in the state where the inner container is placed in the container body, an ice-making area for making ice is formed between an inner peripheral surface of the container body and an outer peripheral surface of the inner container, and the ice-making area is formed as an area where the ice made in the ice-making area is crushed in response to deformation of the container body being grasped.

As an aspect of the present invention, at least one rib may project on at least one of the inner peripheral surface of the container body and the outer peripheral surface of the inner container.

As another aspect of the present invention, a plurality of the at least one ribs may be formed at predetermined intervals in a peripheral direction on the inner peripheral surface of the container body, and each of the ribs may extend in a depth direction of the container body.

As still another aspect of the present invention, the inner container may have a bottomed shape and may have an upper side with an opening therein.

DESCRIPTION OF EMBODIMENTS

An ice-making container according to an embodiment of the present invention will be described below by referring to the attached drawings.

Figure 1:
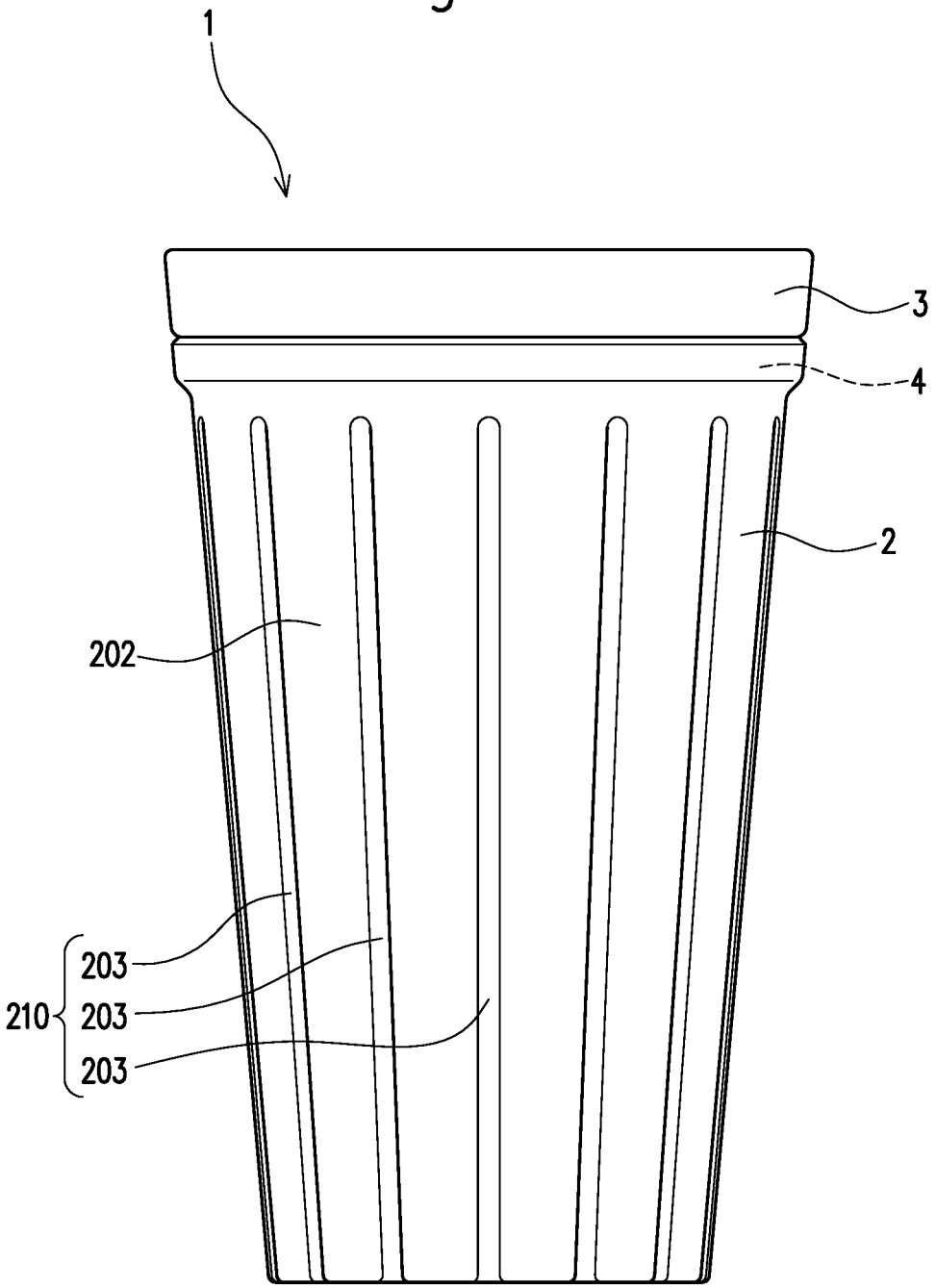
FIG. 1 is a front view of an ice-making container according to an embodiment of the present invention.
Figure 2:
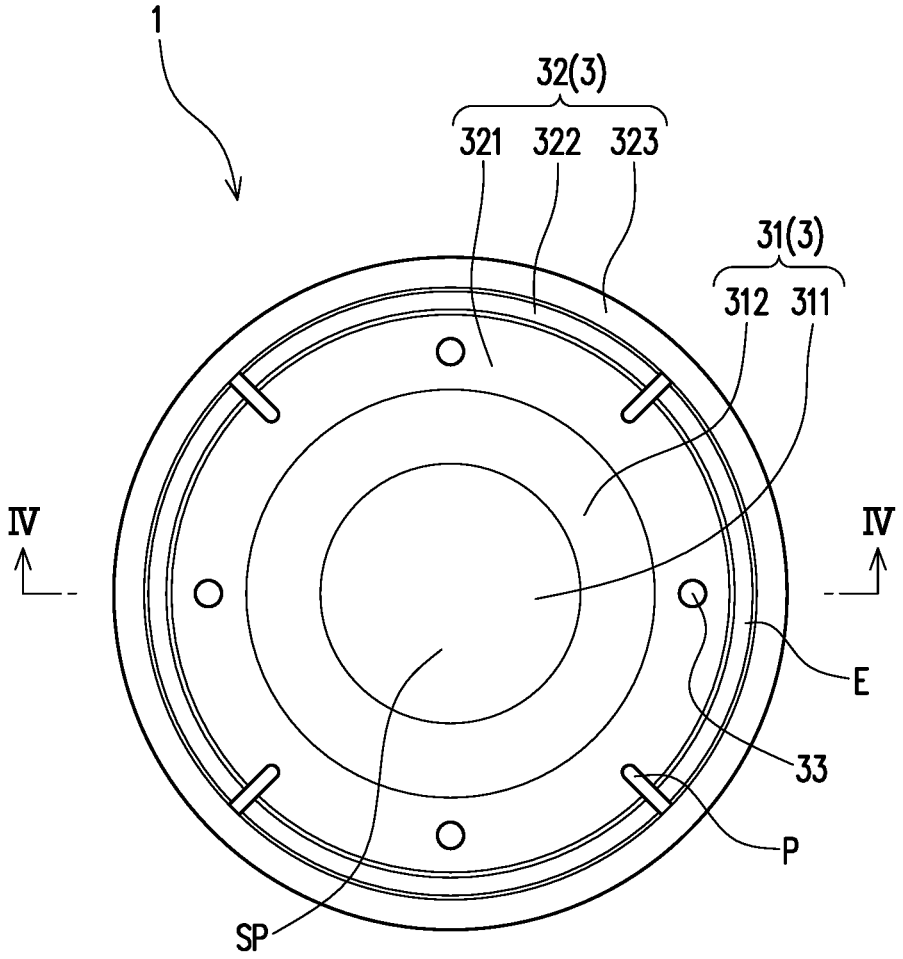
FIG. 2 is a plan view of the ice-making container according to the embodiment.
Figure 3:
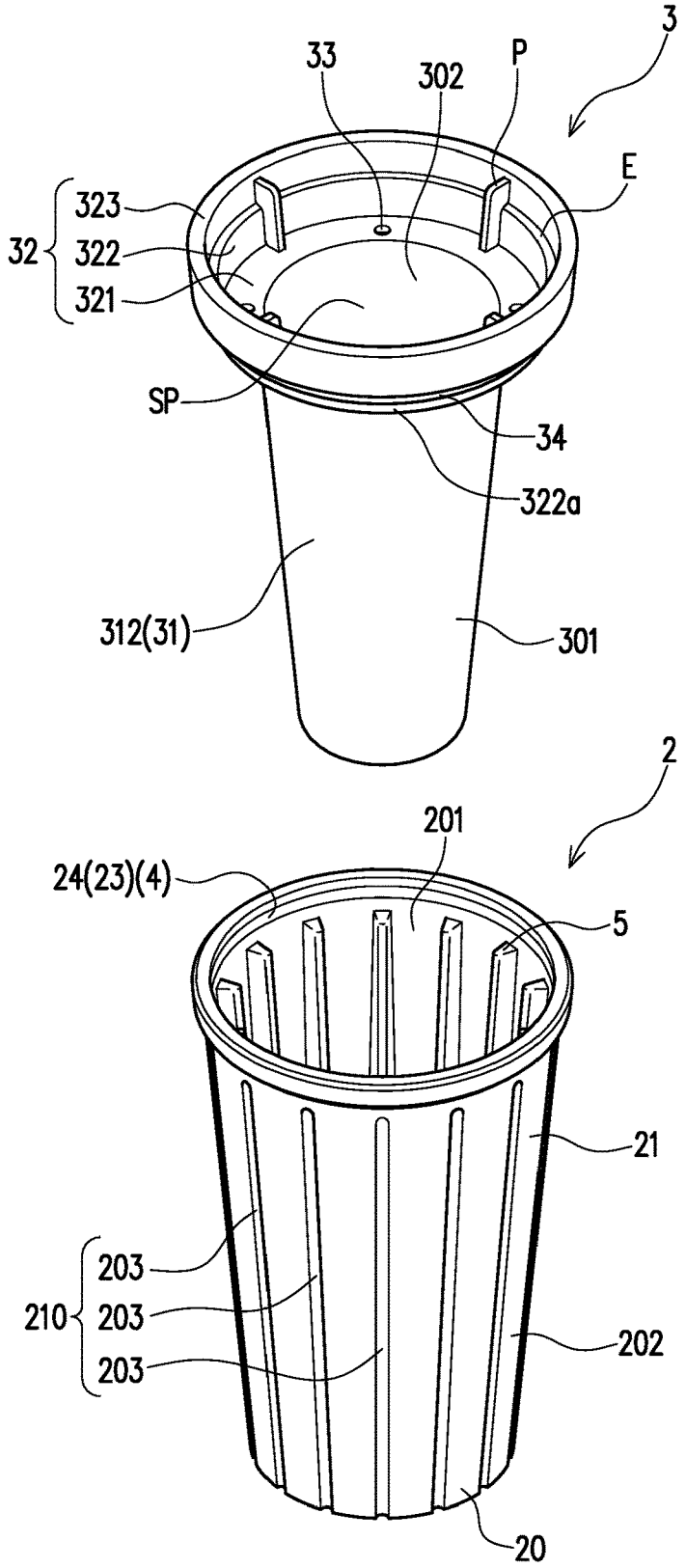
FIG. 3 is a perspective view of the ice-making container according to the embodiment in the state where an inner container is removed from a container body.
Figure 4:
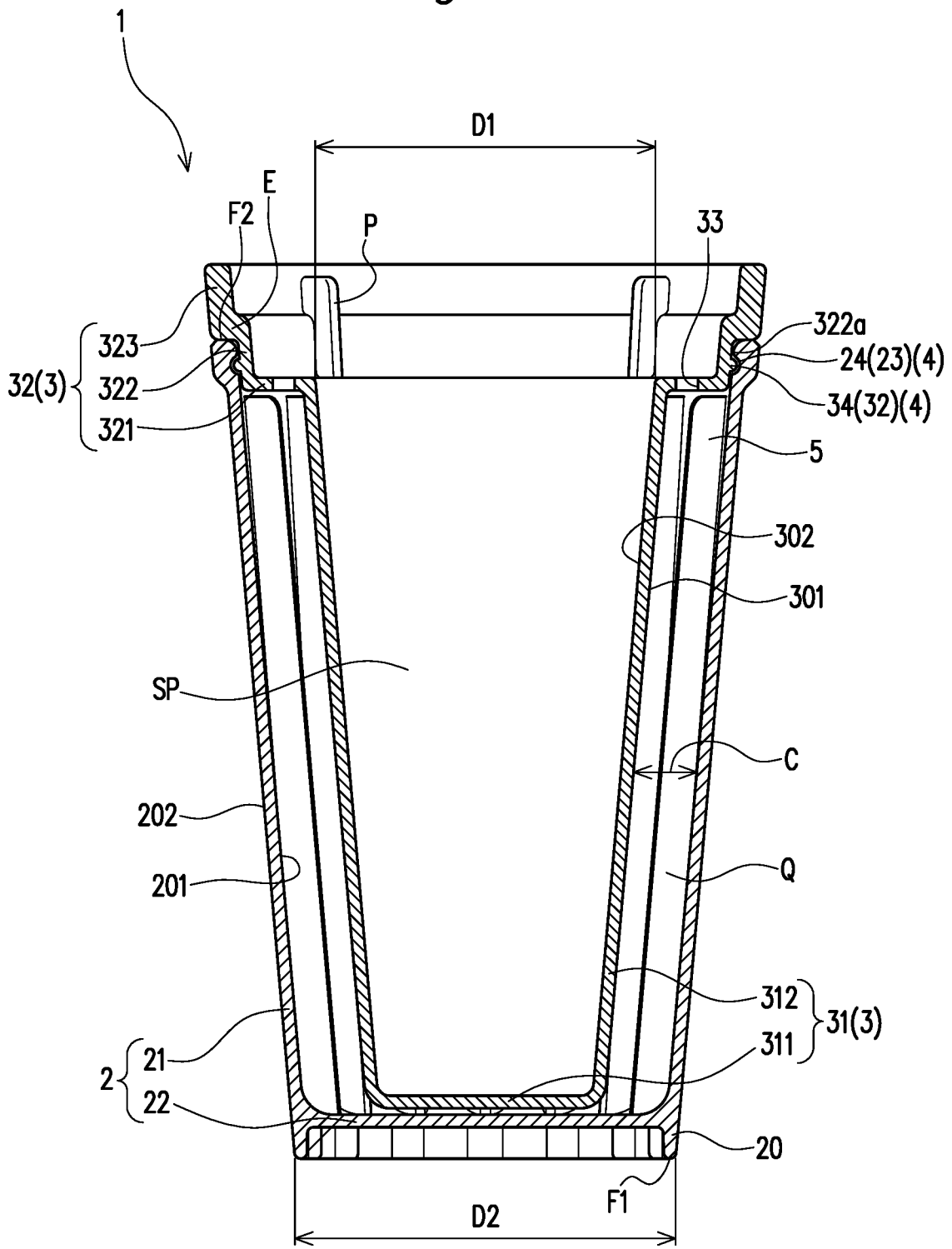
FIG. 4 is a front sectional view of the ice-making container taken along line IV-IV in FIG. 2 according to the embodiment.

As shown in FIGS. 1 to 3, the ice-making container 1 according to the embodiment of the present invention includes a container body 2 configured to be filled with water for making ice, an inner container 3 to be inserted into the container body 2, and fixing means 4 for fixing the inner container 3 to the container body 2. As shown in FIG. 4, while the inner container 3 is placed in the container body 2, an ice-making area Q for making ice S (see FIGS. 7 to 9) is formed between an inner peripheral surface 201 of the container body 2 and an outer peripheral surface 301 of the inner container 3. The ice-making container 1 is configured such that water is filled in the ice-making area Q for making ice. The container body 2 and the inner container 3 are separated from each other so that the ice S is formed with a predetermined thickness. Specifically, the ice S formed in the ice-making area Q is formed with a thickness that allows the ice to be crushed in response to deformation by a force generated by grasping (pressing) the container body 2. The ice-making container 1 of this embodiment has at least one rib 5 projecting on at least one of the inner peripheral surface 201 of the container body 2 and the outer peripheral surface 301 of the inner container 3. The rib 5 is formed in an extending manner toward the ice-making area Q.

Figure 5:
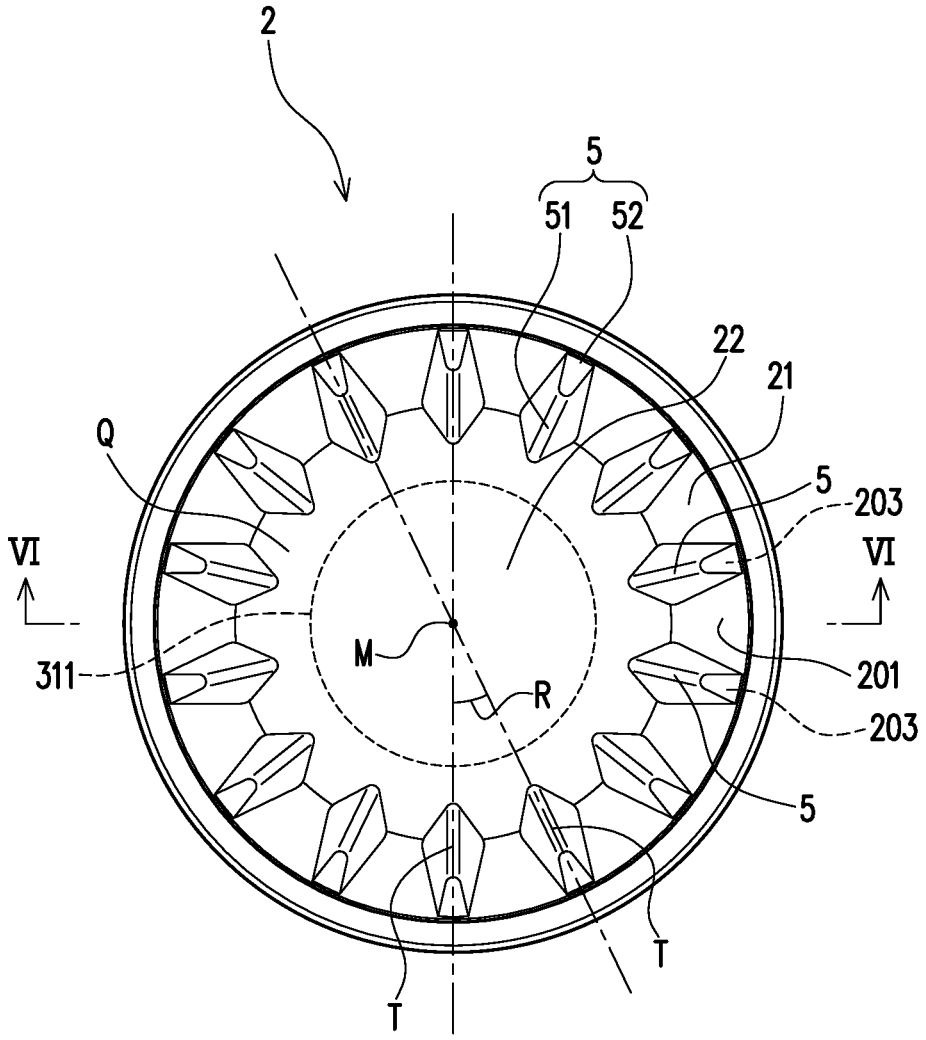
FIG. 5 is a plan view of the container body.
Figure 6:
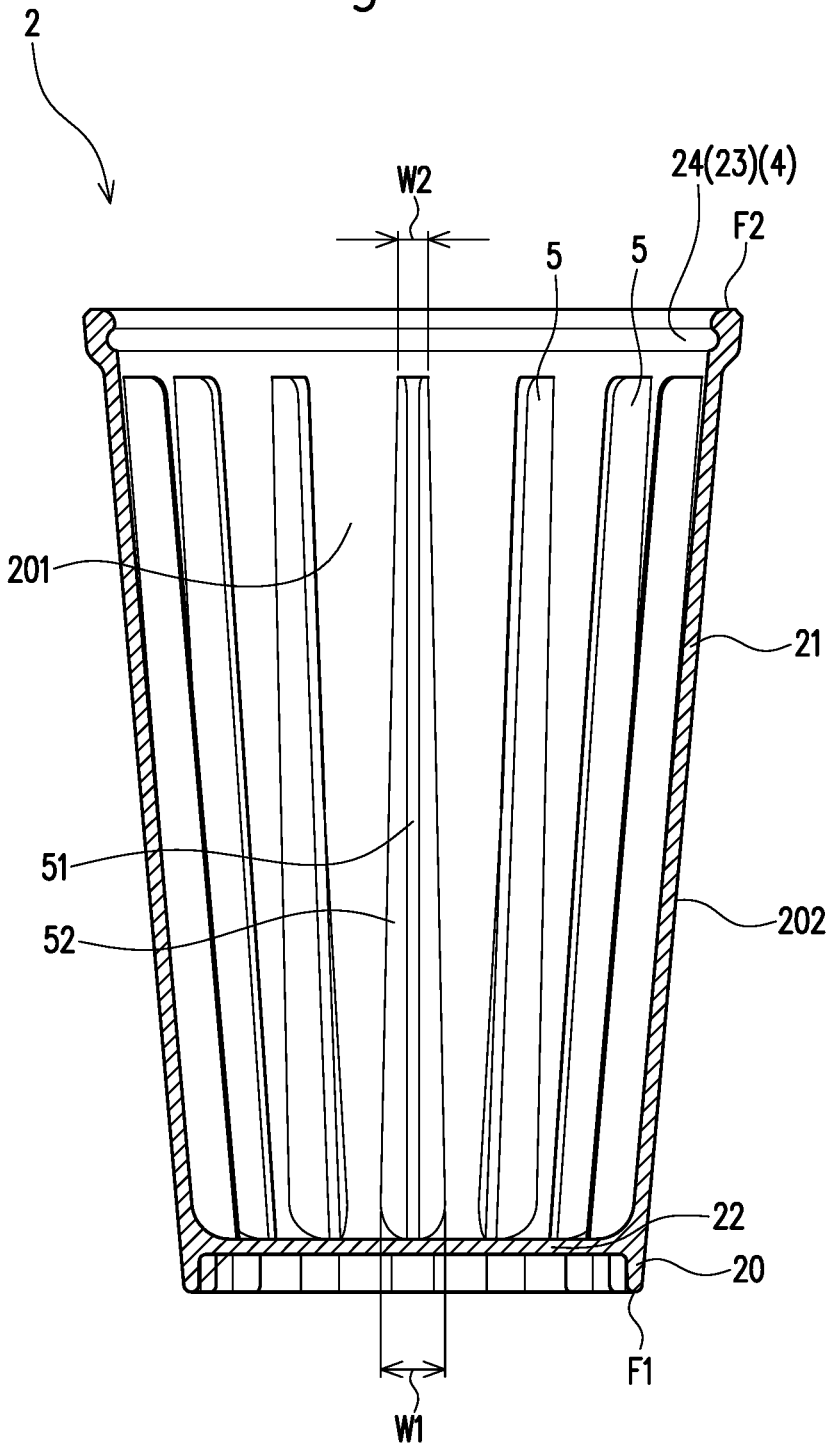
FIG. 6 is a front sectional view of the container body taken along line IV-IV in FIG. 5.

As shown in FIGS. 5 and 6, the container body 2 is a container having a cup shape with an open upper end. That is, the container body 2 includes a side wall portion 21 that has an opening formed in an upper part and that serves as a portion to be grasped by a user, and a bottom portion 22. The container body 2 has an internal space formed by the side wall portion 21 and the bottom portion 22, and the internal space is defined by the inner peripheral surface 201 of the side wall portion 21. The side wall portion 21 is formed with such a height that the facing inner peripheral surfaces 201 of pressed portions abut each other when the container body 2 is pressed. The height of the side wall portion 21 is made to be higher than a length corresponding to a radius of the bottom portion 22. Specifically, the height of the side wall portion 21 is made to have a length of three times to six times of the radius of the bottom portion 22. The container body 2 of this embodiment is configured to be capable of fixing the inner container 3 in the state where the inner container 3 is placed therein. Thus, the container body 2 includes a fixing portion 23 for fixing the inner container 3.

Figure 8:
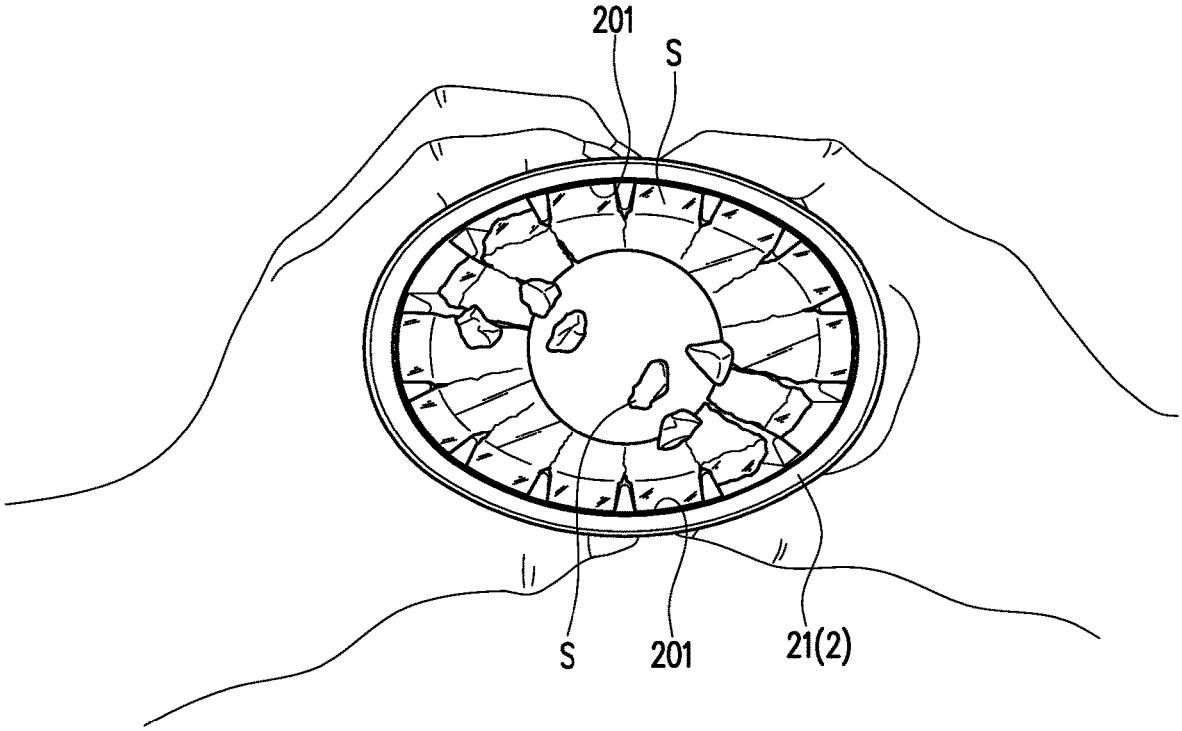
FIG. 8 is a view for explaining a usage state of the ice-making container according to the embodiment and is a view of a state where ice in the ice-making container is being crushed.

The container body 2 is configured to be capable of being grasped. The container body 2 is flexible so as to be deformable by being grasped. Specifically, as shown in FIG. 8, the user grasps the container body 2 in such a manner as to hold the side wall portion 21 between the thumb and the four fingers other than the thumb (the forefinger to the little finger) of one hand or both hands, and presses the side wall portion 21. The container body 2 is deformed by being pressed from both sides of the side wall portion 21 so that the facing inner peripheral surfaces 201 approach each other. The container body 2 is formed of, for example, a resin material such as elastomer or polyethylene. However, the container body 2 only needs to be flexible so as to be deformable by being grasped, and the material is therefore not particularly limited.

In this embodiment, the side wall portion 21 is configured to be elastically deformed by being pressed by one hand or by both hands and to restore to an original shape when not pressed. Thus, the user deforms the side wall portion 21 by pressing the side wall portion 21 of the container body 2 and returns the side wall portion 21 to the original shape by loosening the force exerted by the hand(s) (fingers). The user crushes the ice S in the container body 2 by repeatedly deforming the side wall portion 21 (pressing operation) and returning the shape of the side wall portion 21 (operation of loosening the force exerted by the hand(s) (fingers)) several times.

The side wall portion 21 is formed cylindrically. The side wall portion 21 of this embodiment is formed in a cylindrical shape. The side wall portion 21 of this embodiment is formed so that an outer diameter of an upper end is larger than an outer diameter of a lower end. Specifically, the side wall portion 21 is formed in a shape tapered from the upper end toward the lower end. However, the side wall portion 21 may be formed straight from the upper end toward the other end.

As shown in FIGS. 1 and 3, the side wall portion 21 includes slip preventing means 210 for preventing slippage of the hand(s) of the user. In this embodiment, the slip preventing means 210 are composed of projections and recesses formed on an outer peripheral surface 202 of the side wall portion 21. Specifically, a groove 203 is formed in the outer peripheral surface 202 of the side wall portion 21. The groove 203 is recessed in a thickness direction of the side wall portion 21 and extends from the upper end toward the lower end of the side wall portion 21. Moreover, a plurality of the grooves 203 are formed. The plurality of grooves 203 are arranged so that the adjacent grooves 203 are positioned at an equal interval and aligned in the circumferential direction of the side wall portion 21.

The bottom portion 22 is formed in a plate shape. The bottom portion 22 of this embodiment is formed in a disc shape. The bottom portion 22 of this embodiment is formed in a flat plate shape.

As shown in FIGS. 3 and 4, the fixing portion 23 is provided on the side wall portion 21. The fixing portion 23 is a portion where a lid portion 32 which will be described later of the inner container 3 is fixed. The fixing portion 23 is provided on an upper end portion of the side wall portion 21. Specifically, the fixing portion 23 is a recess portion 24 formed in the inner peripheral surface 201 of the side wall portion 21. The container body 2 and the inner container 3 are fixed together by fitting a projecting portion 34, which will be described later, of the lid portion 32 into the recess portion 24. That is, the fixing means 4 is constituted by the recess portion 24 of the container body 2 and the projecting portion 34 of the inner container 3.

The container body 2 of this embodiment is a circular container having the bottom portion 22 formed in a disc shape and the side wall portion 21 formed in a cylindrical shape. As shown in FIG. 4, in this embodiment, the bottom portion 22 is provided in a middle part on the lower end side of the side wall portion 21. Thus, when the container body 2 is placed on a flat surface, the bottom portion 22 is positioned away from a receiving surface. That is, the container body 2 is placed on the surface with a lower end surface F1 of the side wall portion 21 abutting the receiving surface. With the bottom portion 22 positioned away from the receiving surface, a position of the container body 2 can be kept stable in a freezer even if the bottom portion 22 is deformed as the ice is being made. The shape of the container body 2 is not limited to a circular shape, but as the shape of the container body 2, various shapes such as a square, a triangle, an ellipse and the like can be employed.

The container body 2 is formed so as to have higher rigidity on the lower end portion side than on the upper end portion side. Specifically, the container body 2 is configured such that it becomes less likely for the lower end side to be deformed when the user deforms the container body 2 or the ice is being made. Thus, the container body 2 has a placing portion 20 (bottom portion) having a stable shape, which makes the container body 2 less likely to fall over.

As shown in FIGS. 3 and 4, the inner container 3 is configured to be insertable into and removable from the internal space of the container body 2 through the opening of the container body 2. The inner container 3 includes an inner container body 31 forming the ice-making area Q between itself and the inner peripheral surface 201 of the container body 2 while the inner container 3 is placed in the container body 2, and the lid portion 32 which serves as a lid of the container body 2. The inner container 3 of this embodiment is formed of, for example, a resin material such as elastomer or polyethylene. However, the material of the inner container 3 is not particularly limited. The inner container 3 may be formed of the same material as that of the container body 2, or may be formed of a material different from that of the container body 2. Moreover, the inner container 3 may be formed of a material harder than the container body 2 or may be formed of a material softer than the container body 2.

As shown in FIGS. 3 and 4, the inner container body 31 is formed in an open top type (hollow shape) having a bottom and an opening formed in the upper surface thereof. The inner container body 31 is formed into a cylindrical shape having a bottom in one end and an opening in the other end. That is, the inner container body 31 includes a bottom plate 311 and a peripheral wall 312 extending from a peripheral edge of the bottom plate 311, and the other end, which is opposite to the bottom plate 311, is open. The inner container body 31 of this embodiment is a circular member having the bottom plate 311 formed in a disc shape and the peripheral wall 312 formed a cylindrical shape. In this embodiment, the inner container body 31 is placed in the container body 2 in a concentric manner. Thus, the made ice S is formed in a ring shape (cylindrical shape) covering the entire circumference of the outer peripheral surface 301 of the inner container 3. Moreover, the ice S is formed with a thickness substantially constant over the circumferential direction.

In this embodiment, the bottom plate 311 is formed with a small thickness, and the peripheral wall 312 is formed with a small thickness. A hollow area SP defined by the thin bottom plate 311 and the thin peripheral wall 312 is enlarged. The enlarged hollow area SP allows cold air to be sufficiently led into the hollow area SP and efficiently transmitted into the container body 2 (water in the ice-making area Q).

The inner container body 31 is formed such that an outer diameter of one end on the bottom plate 311 side is smaller than an outer diameter of the other end on the opening side. Specifically, the inner container body 31 has a shape tapered from the upper end toward the lower end. This taper shape allows the inner container 3 to be pulled out of the container body 2 easily after making the ice. However, the inner container body 31 may be formed straight from the upper end toward the lower end. The inner container body 31 of this embodiment has the outer peripheral surface 301 formed smoothly without any projection or recess.

The lid portion 32 is a portion which closes the container body 2. The lid portion 32 extends from the inner container body 31 to have a wider area as it advances outward in a radial direction of the inner container body 31. The lid portion 32 is configured to tightly close (tightly seal) the container body 2. The lid portion 32 includes a base portion 321 covering the opening of the container body 2, a first extension portion 322 extending upward from the base portion 321, and a second extension portion 323 further extending upward from the first extension portion 322 and formed with a diameter larger than that of the first extension portion 322. The lid portion 32 is configured to allow another ice-making container 1 to be placed on the base portion 321. That is, as shown in FIG. 4, the peripheral wall 312 of the inner container body 31 is formed so that an opening diameter D1 on the upper end is smaller than an outer diameter D2 of the placing portion 20 of the container body 2. Thus, the lid portion 32 is capable of placing the container body 2 of another ice-making container 1 on an upper surface of the base portion 321.

The base portion 321 is an annular member connected to an upper end edge of the peripheral wall 312 of the inner container body 31 and extending outward in the radial direction of the inner container body 31 from the upper end edge. The base portion 321 of this embodiment is formed in an annular shape. The upper surface of the base portion 321 has a projecting piece P connected to the first extension portion 322 and the second extension portion 323. The projecting piece P connects the base portion 321, the first extension portion 322, and the second extension portion 323 so as to increase strength of the inner container 3 (lid portion 32). Moreover, the projecting piece P functions also as a spacer for preventing the container body 2 of another ice-making container 1 placed on the base portion 321 from being displaced in the radial direction of the base portion 321.

The first extension portion 322 extends upward from the upper surface of the base portion 321. The first extension portion 322 of this embodiment extends upward from an end edge of the base portion 321. The first extension portion 322 has a projecting portion 34 formed on an outer peripheral surface 322*a* along the circumferential direction. The projecting portion 34 is configured to be fitted in the recess portion 24 of the container body 2. When the projecting portion 34 is fitted in the recess portion 24 of the container body 2, the inner container 3 is fixed to the container body 2. The projecting portion 34 is formed in such a manner as to extend along the entire circumference of the outer peripheral surface 322*a* of the first extension portion 322.

The second extension portion 323 extends upward from the outer peripheral surface of the first extension portion 322 and extends outward in the radial direction of the first extension portion 322. That is, a stepped portion E is formed between the second extension portion 323 and the first extension portion 322.

As shown in FIG. 4, the lid portion 32 is fixed to the container body 2 when the first extension portion 322 is fitted in the container body 2. That is, in the state where the inner container 3 is fixed to the container body 2, the base portion 321 and the first extension portion 322 are positioned in the container body 2, and the second extension portion 323 is in the state exposed outside the container body 2. Moreover, when the inner container 3 is fixed to the container body 2, the stepped portion E between the first extension portion 322 and the second extension portion 323 is placed on an upper end surface F2 of the container body 2. With this configuration, the stepped portion E prevents the inner container 3 from dropping into the container body 2.

A discharge portion 33 is formed in the base portion 321 to discharge water overflowing in the container body 2. The discharge portion 33 is formed as a hole penetrating the base portion 321 in a thickness direction. The discharge portion 33 is a portion for releasing excessive water when the inner container 3 is inserted into the container body 2 filled with water or when a volume of the water expands as it is being cooled.

The ice-making area Q formed between the inner peripheral surface 201 of the container body 2 and the outer peripheral surface 301 of the inner container 3 (inner container body 31) is formed as an area where the ice S is crushed in response to deformation of the container body 2 being grasped. That is, the inner peripheral surface 201 of the container body 2 and the outer peripheral surface 301 of the inner container body 31 are set (adjusted) to separate from each other by such a distance as to have the ice S crushed when the container body 2 is grasped and pressed by the hand (one hand or both hands). In this embodiment, a clearance C (see FIG. 4) between the inner peripheral surface 201 of the container body 2 and the outer peripheral surface 301 of the inner container body 31 is set to have a width of 7 mm or more and 15 mm or less. Specifically, the clearance C is set to have a width of 10 mm.

As shown in FIGS. 5 and 6, the rib 5 projects on the inner peripheral surface 201 of the container body 2. In this embodiment, a plurality of the ribs 5 are formed at predetermined intervals in the circumferential direction on the inner peripheral surface 201 of the container body 2, and each rib 5 extends in a depth direction of the container body 2. The depth direction is a direction along a height direction connecting the opening of the container body 2 and the bottom portion 22. The plurality of the ribs 5 are arranged on the inner peripheral surface 201 of the container body 2 at equal intervals. The plurality of the ribs 5 are formed independently of each other (in the separate state). The greater the number of the ribs 5 is, the smaller a volume of the ice S per section defined by each two adjacent ribs 5 provided at an interval becomes, which results in the excessively small crushed ice. On the contrary, the smaller the number of ribs 5 is, the greater the volume of the ice S per section becomes, which makes the ice S harder to be crushed (greater force is required for crushing). In this embodiment, the number of the ribs 5 is set appropriately in accordance with a size of the container body 2 so that the volume of the ice S sectioned with recesses by the ribs 5 (the ice S located between the adjacent ribs 5) does not become too small or too large. Specifically, as shown in FIG. 5, the number of ribs 5 is set so that a center angle R of a fan shape formed by width centers T of the adjacent ribs 5 (width centers T of a width with reference to the circumferential direction of the ice-making container 1) and a center M of the container body 2 is 15 degrees or more and 40 degrees or less. In this embodiment, the container body 2 has 14 ribs 5 provided.

FIG. 5 virtually shows the bottom plate 311 of the inner container 3 with a broken line in order to show the ice-making area Q. As shown in FIG. 5, the ribs 5 are formed so that a top end portion 51 extending toward the ice-making area Q side is thinner than a base end portion 52 side connected to the container body 2. In this embodiment, the ribs 5 have a shape tapered from the base end portion 52 side toward the top end portion 51 side. The ribs 5 are formed with such rigidity that the top end portion 51 is less likely to fall aside or laterally move with respect to the base end portion 52. This configuration prevents the ribs 5 from sticking to the ice S (allows the ribs 5 to easily come off the ice 5) when the ice S is being crushed. Specifically, the ribs 5 are formed in a triangular prism shape. Moreover, the ribs 5 are formed at positions corresponding to the grooves 203 formed in the outer peripheral surface 202 of the container body 2. That is, the grooves 203 are formed in the outer peripheral surface 202 on the rear side of the ribs 5.

As shown in FIG. 6, the ribs 5 are formed from the upper end portion to the lower end portion of the container body 2. The ribs 5 are configured to section with recesses the ice S made in the ice-making area Q along the depth direction, or in other words to form grooves for dividing the ice S into a segment on one side of the grooves and the segment on the other side, which enables even a user with inadequate hand strength including a woman or a child to crush the ice easily. The ribs 5 in this embodiment are formed so that a width W of the base end portion 52 increases from the upper end portion of the container body 2 toward the lower end portion thereof. The ribs 5 are formed to have a width W1 on the lower end portion side of the container body 2 larger than a width W2 on the upper end portion side thereof. The lower a projecting height of the ribs 5 is, the larger the volume of the ice S to be made becomes; however, the ribs 5 having a lower height section the ice S with recesses more shallowly, which makes it harder for the user to crush the ice S. The ribs 5 are therefore set to such an optimal height that allows the made ice S to be sectioned with recesses deeply enough to crush the ice S easily and a required volume of the ice S to be ensured. In this embodiment, the ribs 5 are set to such a height that the top end portion 51 does not abut (does not reach) the outer peripheral surface 301 of the inner container 3. That is, the ribs 5 are formed shorter than a distance between the inner peripheral surface 201 of the container body 2 and the outer peripheral surface 301 of the inner container 3. The height of the ribs 5 of this embodiment is set to 3 mm or more and the width of the clearance C or less. Specifically, the ribs 5 have a height of 5 mm.

Figure 7:
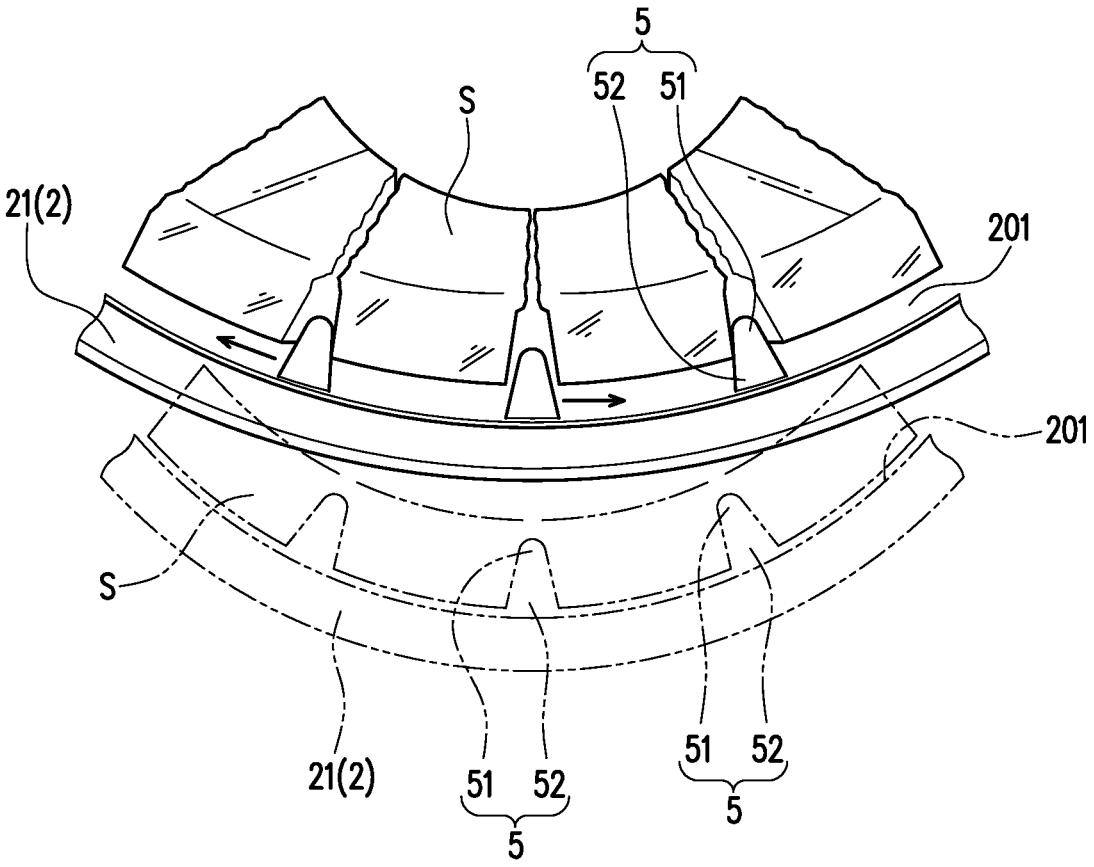
FIG. 7 is a view for explaining states before deformation and after deformation of the container body according to the embodiment.

As shown in FIG. 7, when the container body 2 is deformed, the side wall portion 21 is deformed from a curved state (shown in broken line) to a nearly flat state (shown in solid line) in this embodiment. With this deformation, the ice S is broken at a portion formed thinly by each rib 5 so that a plurality of bar-shaped pieces of the ice S are formed. The top end portions 51 of the adjacent ribs 5, which are close to each other before the container body 2 is deformed (shown in broken line), separate from each other as the main container body 2 is deformed (shown in solid line, see the arrows). This allows the ice S between the adjacent ribs 5 to be easily released from the inner peripheral surface 201 of the container body 2.

The explanation of the ice-making container 1 according to this embodiment has been made. Next, a method of using the ice-making container 1 will be described by referring to the attached drawings.

The user fills the container body 2 with water and inserts the inner container 3 into the container body 2. The user fits the lid portion 32 of the inner container 3 in the container body 2 for fixation to prevent the inner container 3 from floating by its own buoyancy. Then, the user puts the ice-making container 1 into the freezer. When intending to make ice using a plurality of ice-making containers 1, the user places another ice-making container 1 on the base portion 321 of the ice-making container 1 to stack these upward.

After making the ice, the user pours water into the hollow area SP in the inner container 3. While the ice S adhering to the outer peripheral surface 301 of the inner container 3 is molten by the poured water, the user grasps and slightly rotates the inner container 3 in one direction along the circumferential direction, and then slightly rotates the same in the opposite direction. The user pulls out the inner container 3 from the container body 2 when the ice S is released from the inner container 3.

Figure 9:
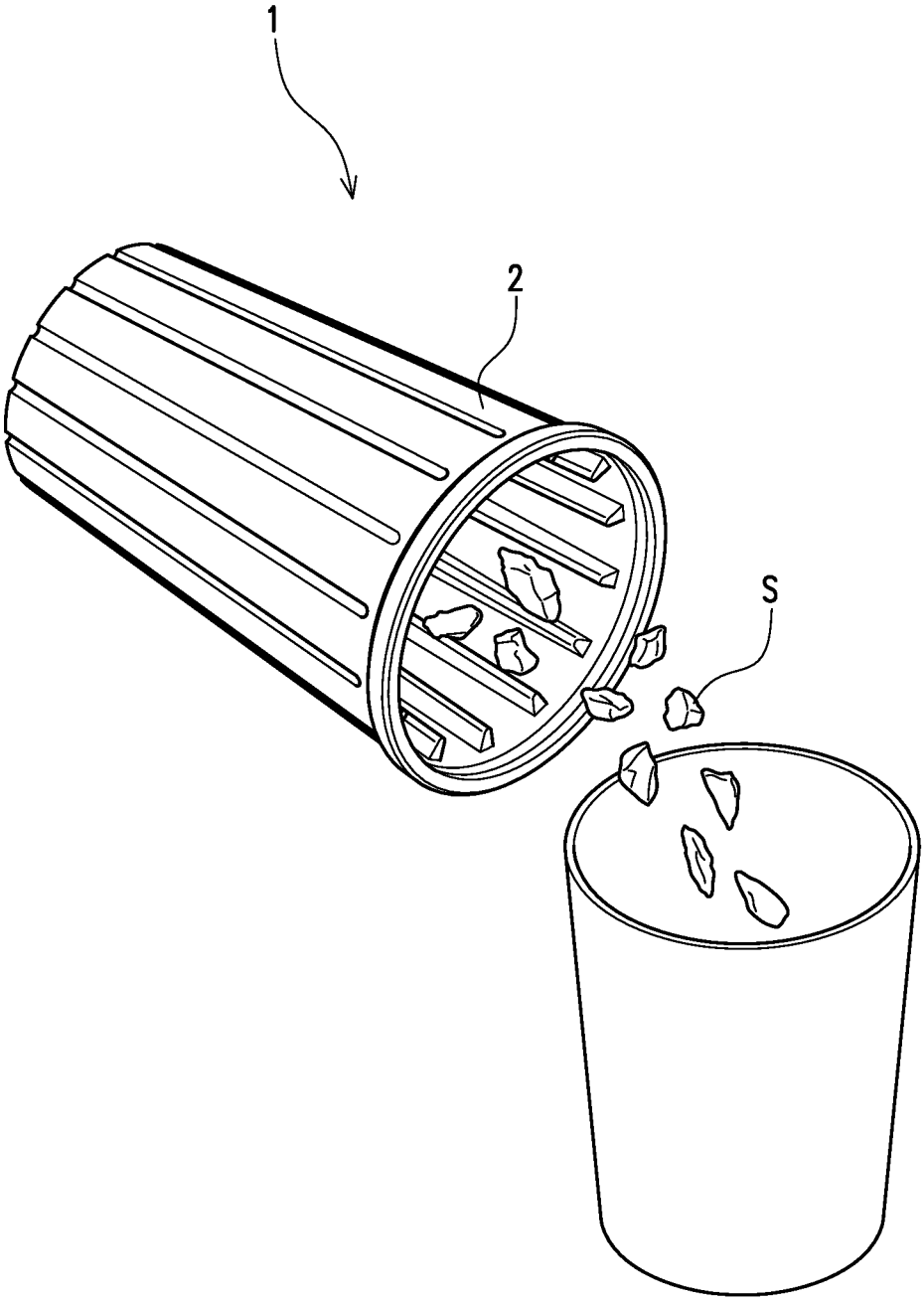
FIG. 9 is a view for explaining a usage state of the ice-making container according to the embodiment and is a view of a state where the ice in the ice-making container is being moved to another container.

Subsequently, as shown in FIG. 8, the user crushes the ice S by grasping and pressing the container body 2 by both hands or one hand. When the ice S is sufficiently crushed, as shown in FIG. 9, the user throws the crushed ice directly from the container body 2 into another container.

As described above, the ice-making container 1 according to the aforementioned embodiment includes a container body 2 having an opening formed in an upper part and being flexible so as to be deformable by being grasped and an inner container 3 configured to be insertable into and removable from the container body 2 through the opening, wherein an ice-making area Q for making an ice S is formed between an inner peripheral surface 201 of the container body and an outer peripheral surface of the inner container 3 while the inner container 3 is placed in the container body 2, and the ice-making area Q is formed as an area where the ice S made in the ice-making area Q is crushed in response to deformation of the container body 2 being grasped.

According to the aforementioned embodiment, the ice S is made in the ice-making area Q by inserting the inner container 3 into the container body 2 with water therein and by putting the ice-making container 1 in a freezer while the inner container 3 is placed in the container body 2. The ice-making area Q is formed as an area where the ice S is crushed in response to deformation of the container body 2 being grasped. Thus, after making the ice, a user can crush the ice S when grasping and deforming the container body 2. Then, the user can move (throw) the crushed ice S as the content of the container main body 2 from the container body 2 to another container. As described above, the ice-making container 1 having the aforementioned configuration allows the user to move the crushed ice S to another container without touching the ice S, which is hygienic.

In the aforementioned embodiment, at least one rib 5 projects on at least one of the inner peripheral surface 201 of the container body 2 and the outer peripheral surface 301 of the inner container 3.

According to the aforementioned embodiment, the ice S made in the ice-making area Q is sectioned with recess into a plurality of blocks by the at least one rib 5 projecting on at least one of the inner peripheral surface 201 of the container body 2 and the outer peripheral surface of the inner container 3. This sectioning with recess decreases the volume of the ice S, and thus allows the ice S to be easily crushed.

In the aforementioned embodiment, a plurality of the ribs 5 are formed at predetermined intervals in the circumferential direction on the inner peripheral surface 201 of the container body 2, and each of the ribs extends in the depth direction of the container body 2.

According to the aforementioned embodiment, when the user presses and deforms the container body 2, the deformation of the container body 2 causes the adjacent ribs 5 located on the pressed portions to separate in the direction away from the ice S. The ice-making container 1 with the aforementioned configuration provides ease of releasing the ice.

In the aforementioned embodiment, the inner container 3 is formed in an open top type having a bottom, and an opening formed in the upper surface thereof.

According to the aforementioned embodiment, cold air can be led from the opening of the inner container 3 into the inner container 3 when the ice-making container 1 is put in the freezer while the inner container 3 is inserted from the bottom side into the container body 2 with water therein and the ice-making area Q is filled with the water. This configuration allows the water in the ice-making area Q to be cooled from outer and inner sides of the container body 2, enabling efficient ice-making.

When the inner container 3 is to be pulled out of the container body 2 after making the ice, water is poured into the inner container 3 to melt the ice S adhering to the outer peripheral surface 301 of the inner container 3 so that the ice is easily released from the inner container 3. Thus, the ice-making container 1 of this embodiment can be easily pulled out of the container body 2 after making the ice.

In the aforementioned embodiment, the container body 2 is formed so that a lower end portion side has higher rigidity than that of an upper end portion side, and the ribs 5 are formed so that the width W1 on the lower end portion side of the container body 2 is larger than the width W2 on the upper end portion side. Thus, the ice-making container 1 of the aforementioned embodiment can form the ice S with a smaller width on the lower end portion side where the container body 2 cannot be deformed easily so that the ice S can be crushed easily even on the lower end portion side of the container body 2. This configuration allows the ice-making container 1 of the aforementioned embodiment to make uniform crushed ice.

In the aforementioned embodiment, the lid portion 32 of the inner container 3 is configured to tightly close (tightly seal) the container body 2, and therefore the ice S is less likely to absorb odor in the freezer.

In the aforementioned embodiment, the lid portion 32 is configured to allow another ice-making container 1 to be placed on the base portion 321. This configuration allows a plurality of the ice-making containers 1 to be stacked vertically in the freezer, and to be accommodated in a space-saving manner when they are used.

This embodiment provides the ice-making container 1 capable of moving the crushed ice to a certain container hygienically.

The ice-making container 1 of the present invention is not limited to the aforementioned embodiment. The ice-making container 1 according to the present invention is not limited to the aforementioned operational effects, either. Various changes are applicable to the ice-making container 1 according to the present invention within a range not departing from the gist of the present invention.

The description of the aforementioned embodiment is made by taking the case where the ice S is crushed while the inner container 3 is removed from the container body 2 after making the ice, without limitation thereto. For example, the inner container body 31 may be formed of a soft resin deformable in response to deformation of the container body 2 so that the ice S is crushed with the inner container 3 placed in the container body 2 (that is, with the inner container 3 closing the container body 2).

The description of the aforementioned embodiment is made by taking the case where the bottom portion 22 is formed in a flat plate shape, without limitation thereto. The bottom portion 22 may be formed to incline downward from its peripheral edge to its center. That is, the bottom portion 22 may be formed so that the center part projects downward with respect to the peripheral edge portion. This shape allows the ice S adhering to the base portion 22 to be released from the container body 2 when a central portion of the base portion 22 is pressed after the inner container 3 is removed from the container body 2. Additionally, the bottom portion 22 may have a rib 5 projecting thereon.

Though not particularly referred to in the aforementioned embodiment, the container body 2 may have a mark indicating an amount of water to be poured so that the ice-making area Q is filled with an appropriate amount of water.

Figure 10:
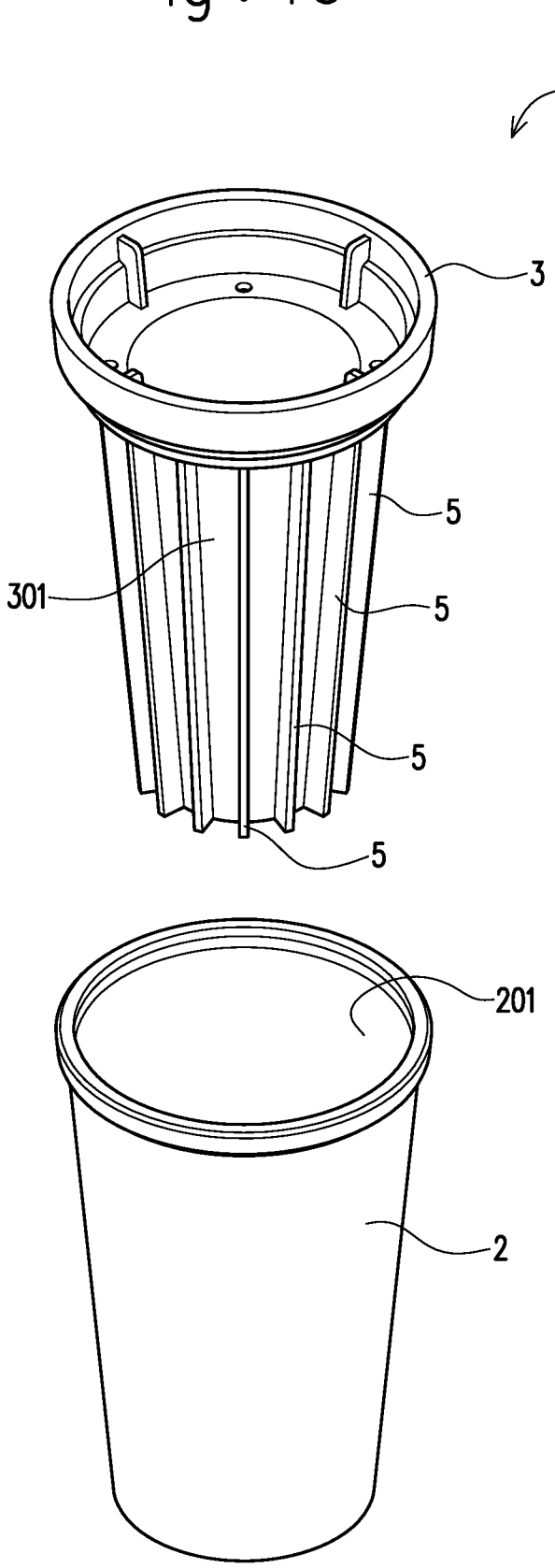
FIG. 10 is an ice-making container according to another embodiment.

The description of the aforementioned embodiment is made by taking the case where the ribs 5 are formed on the inner peripheral surface 201 of the container body 2, without limitation thereto. As shown in FIG. 10, the ribs 5 may be formed on the outer peripheral surface 301 of the inner container 3. The ribs 5 may also be formed on both the inner peripheral surface 201 of the container body 2 and the outer peripheral surface 301 of the inner container 3.

The description of the aforementioned embodiment is made by taking the case where a plurality of the ribs 5 are formed, without limitation thereto. The ribs 5 do not have to be formed, or one rib may be formed on at least one of the inner peripheral surface 201 of the container body 2 and the outer peripheral surface 301 of the inner container 3. The one rib 5 formed sections with recess the made ice S along at least one line, which makes it easier to crush the ice S than the case where no rib 5 is formed.

The description of the aforementioned embodiment is made by taking the case where a plurality of the ribs 5 extend in the depth direction of the container body 2 and are formed at predetermined intervals in the circumferential direction on the inner peripheral surface 201 of the container body, without limitation thereto. The ribs 5 may extend along the circumferential direction on the inner peripheral surface 201 of the container body 2 and may be formed at predetermined intervals in the depth direction of the container body 2. That is, the ribs 5 may be formed in a ring shape on the inner peripheral surface 201 of the container body 2.

The description of the aforementioned embodiment is made by taking the case where the ribs 5 are formed so that the top end extending to the ice-making area Q side is thinner than the base end side connected to the container body 2, without limitation thereto. The ribs 5 may be formed so that the base end side and the top end side have the same thickness as each other.

The description of the aforementioned embodiment is made by taking the case where the top ends of the ribs 5 are set to such a height that they do not abut (do not reach) the outer peripheral surface 301 of the inner container 3, without limitation thereto. The top ends of the ribs 5 may be formed with such a height that they abut the outer peripheral surface 301 of the inner container 3.

The description of the aforementioned embodiment is made by taking the case where the inner container 3 is formed in an open top type (hollow shape) having a bottom, without limitation thereto. The inner container 3 may be formed in a columnar shape (solid state).

The description of the aforementioned embodiment is made by taking the case where the made ice S is formed in a ring shape (cylindrical shape) covering the entire circumference of the outer peripheral surface 301 of the inner container 3, without limitation thereto. For example, the inner container 3 may be formed in a plate shape and arranged in the container body 2 having a rectangular shape so as to connect opposite sides thereof to each other, so that the ice S having a plate shape may be made through the inner container 3.

The description of the aforementioned embodiment is made by taking the case where the fixing portion 23 is the recess portion 24 formed in the side wall portion 21 and the container body 2 and the inner container 3 are fixed together by fitting the projecting portion 34 of the inner container 3 into the recess portion 24, without limitation thereto. For example, the fixing portion 23 may be formed in a hook shape extending from the upper end portion of the side wall portion 21. Accordingly, the lid portion 32 may have a locking portion by which the fixing portion 23 is locked.

Though not particularly referred to in the aforementioned embodiment, the inner container 3 may be formed of an elastically deformable material. The inner container 3 formed of the elastically deformable material is made slightly deformable when the user rotates the inner container 3 at the time of pulling it out of the container body 2, which makes it easier to rotate and pull the inner container 3 out of the container body 2.

The description of the aforementioned embodiment is made by taking the case where the plurality of ribs 5 are formed independently of each other, without limitation thereto. The plurality of ribs 5 may be connected to each other. The plurality of ribs 5 may be connected to each other on the lower end side or the upper end side in, for example, a V-shape or a W-shape.

The description of the aforementioned embodiment is made by taking the case where the clearance C between the inner peripheral surface 201 of the container body 2 and the outer peripheral surface 301 of the inner container body 31 and the number of the ribs 5 are set to fall within the predetermined range; however, the clearance C and the number of ribs 5 may be freely set. For example, the clearance C may be made larger (e.g. 20 mm) while the number of ribs 5 may be increased to have narrower intervals between the ribs 5, thereby enabling the ice S to be formed thin enough to be crushable (e.g. 10 mm).

REFERENCE SIGNS LIST

1: Ice-making container
2: Container body
20: Placing portion
21: Side wall portion
22: Bottom portion
23: Fixing portion
24: Recess portion
201: Inner peripheral surface
202: Outer peripheral surface
203: Groove
210: Slip preventing means
3: Inner container
31: Inner container body
32: Lid portion
33: Discharge portion
34: Projecting portion
301, 322*a*: Outer peripheral surface
302: Inner peripheral surface
311: Bottom plate
312: Peripheral wall
321: Base portion
322: First extension portion
323: Second extension portion
4: Fixing means
5: Rib
C: Clearance
P: Projecting piece
Q: Ice-making area
SP: Hollow area
S: Ice
W, W1, W2: Rib width

The invention claimed is:

1. An ice-making container comprising:

a container body having an opening formed in an upper part and being flexible so as to be deformable by being grasped; and an inner container configured to be insertable into and removable from the container body through the opening, wherein an ice-making area for making ice is formed between an inner peripheral surface of the container body and an outer peripheral surface of the inner container while the inner container is placed in the container body; and the ice-making area is formed as an area where the ice made in the ice-making area is crushed in response to deformation of the container body being grasped.

2. The ice-making container according to claim 1, wherein at least one rib projects on at least one of the inner peripheral surface of the container body and the outer peripheral surface of the inner container.

3. The ice-making container according to claim 2, wherein a plurality of the at least one ribs are formed at predetermined intervals in a peripheral direction on the inner peripheral surface of the container body, and each of the ribs extends in a depth direction of the container body.

4. The ice-making container according to claim 1, wherein the inner container has a bottom, and an opening formed in an upper surface thereof.

* * * * *